United States Patent [19]

McGill et al.

[11] Patent Number: 4,824,735

[45] Date of Patent: Apr. 25, 1989

[54] CASTING TRANSITION METAL ALLOY CONTAINING RARE EARTH METAL

[75] Inventors: Ian R. McGill, Thatcham; David Kennedy, Runcorn, both of United Kingdom

[73] Assignee: Johnson Matthey Public Limited Company, London, United Kingdom

[21] Appl. No.: 151,530

[22] Filed: Feb. 2, 1988

Related U.S. Application Data

[62] Division of Ser. No. 024,075, Mar. 10, 1987, Pat. No. 4,739,818.

[30] Foreign Application Priority Data

Mar. 10, 1986 [GB] United Kingdom ..... 8605878

[51] Int. Cl.[4] ..... B32B 15/04

[52] U.S. Cl. ..... 428/610; 428/613; 428/661; 428/668; 428/615

[58] Field of Search ..... 164/98–105, 164/106, 107, 95, 94, 96; 420/416; 428/610, 629, 615, 660, 661, 668, 678, 685, 674, 613, 612, 687, 472.1

[56] References Cited

U.S. PATENT DOCUMENTS

| | | | |
|---|---|---|---|
| 3,856,579 | 12/1974 | Allen | 204/192.15 |
| 4,121,924 | 10/1978 | de Barbadello | 420/416 |
| 4,202,022 | 5/1980 | Imamura et al. | 420/416 |
| 4,561,484 | 12/1985 | Usui et al. | 164/101 |

FOREIGN PATENT DOCUMENTS

| | | | |
|---|---|---|---|
| 18942 | 11/1980 | European Pat. Off. | 420/416 |
| 60-56465 | 4/1985 | Japan | 164/98 |

OTHER PUBLICATIONS

M. Copeland et al., "Stainless Steel-Gadolinium Alloys", Bureau of Mines report of investigations-6636, U.S. Dept. Int., 1965, pp. 1-29.

*Primary Examiner*—John J. Zimmerman

*Attorney, Agent, or Firm*—Cushman, Darby & Cushman

[57] ABSTRACT

A process for casting molten transition metal alloy comprising 15 to 35 at % of rare earth metal in which the molten alloy is contacted with a surface (26) of a backing member (25) and the alloy is caused to solidify whilst in contact with the surface (26) such that when the alloy has solidified there is produced a unitary structure (21) comprising a solid layer (27) of the alloy bonded to the backing member (25). The process minimizes the effects of cracking in the alloy and facilitates the use of the alloy as a sputter target.

8 Claims, 2 Drawing Sheets

CASTING TRANSITION METAL ALLOY CONTAINING RARE EARTH METAL

Figure 1:
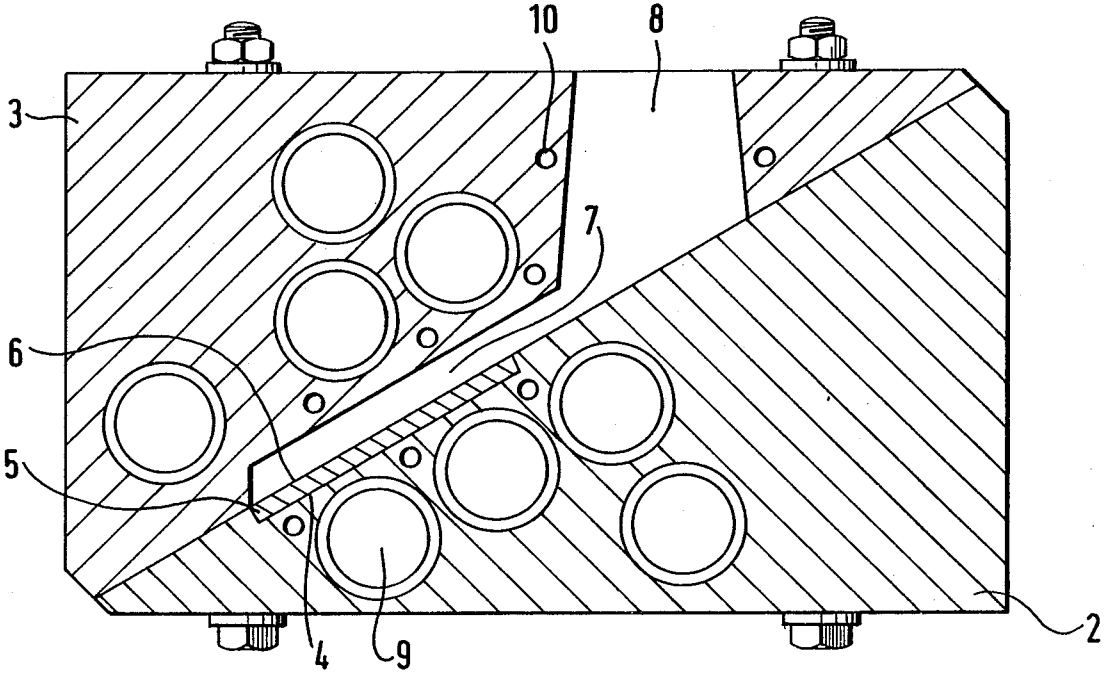

This is a division of application Ser. No. 024,075 filed Mar. 10, 1987, now U.S. Pat. No. 4,739,818.

This invention relates to a process for casting molten transition metal alloy containing 15 to 35 atomic % of a rare earth metal wherein the transition metal consists of at least one member of the 4*b*, 5*b*, 6*b*, 7*b* and 8 Groups of the Periodic Table as shown on the inside front cover of the 60th edition of the "CRC Handbook of Chemistry and Physics" edited by CRC Press Incorporated of Boca Raton, Fla., USA. The preferred transition metals are iron, cobalt and nickel and especially alloys of iron and cobalt. The rare earth metal preferably consists of at least one member of the lanthanide series (preferably excluding promethium) and/or 3*b* Group (preferably excluding actinium) of the Periodic Table as specified above. Preferred rare earth metals are terbium, gadolinium and dysprosium. The invention also relates to a unitary structure comprising a layer of transition metal alloy.

Transition metal alloys containing 15 to 35 at % of rare earth metal are useful commercially, for example as sputter targets. However the alloys are intrinsically brittle and hitherto they have shattered into discrete pieces when being cast. It has been the practice to glue the shattered pieces back together in order to produce an integral structure capable of being used as a sputter target. One of the objects of this invention is to avoid the need to glue together shattered pieces by providing a process for casting alloys which can produce a unitary structure.

According to a first aspect of this invention there is provided a process for casting a molten transition metal alloy containing 15 to 35 at % of rare earth metal wherein the transition metal consists of at least one member of the 4*b*, 5*b*, 6*b*, 7*b* and 8 Groups of the Periodic Table, the process comprising (a) contacting the molten alloy with a surface of a backing member, and (b) causing the alloy to solidify whilst in contact with the said surface, wherein the said surface is provided by a material which is capable of bonding to the alloy so as to form a unitary structure comprising a layer of the alloy bonded to the backing member.

The simplest form of bonding is mechanical keying in which molten alloy solidifies and keys into for example fissures and/or pores in the surface of the backing member. Mechanical keying maintains a unitary structure but it is often insufficient to prevent cracks in the alloy from extending both perpendicularly to, and all the way between opposed surfaces of the alloy layer. Accordingly, it is preferred to use fusion bonding to unite the alloy layer with the backing member, that is to say it is preferred that the material which provides the surface of the backing member should be a material which is able to diffuse into the molten alloy with or without a chemical reaction whereby when the molten alloy contacts the surface, at least some of the material providing the surface diffuses into the molten alloy to form at least one zone comprising alloy mixed with material of the surface. Thus, when the alloy solidifies, there is produced at least one such zone bonding the alloy layer to the backing member. It has been found that these zones in some way interfere with the formation of cracks in the alloy layer with the result that most (generally at least 80%) and probably all of the cracks extend diagonally between opposed surfaces of the alloy layer and/or extend from one surface of the alloy layer and terminate in the vicinity of a zone so that the crack only extends part way across the alloy layer.

The backing member (including its surface) may comprise at least one metal from the 1*b*, 2*b*, 3*b*, 4*b*, 5*b*, 6*b*, 7*b*, 8 Groups and the lanthanide series of the Periodic Table as specified above and their alloys. Where the metal has a melting point below the temperature of the molten alloy, it may be necessary (and usually is necessary if the melting point is below 800° C.) to subject the backing member to positive cooling to ensure that heat is extracted from the backing member quickly enough to keep it sufficiently solid. For fusion bonding, the backing member is preferably formed from the metals of Groups 1*b*, 5*b*, 6*b*, 7*b* and 8 because of their ability to diffuse into or react chemically with the molten alloys used in the process of this invention. For structures intended for use for example as sputter targets, it is preferred to use a backing member formed from a non-ferromagnetic material such as copper and its alloys, austenitic stainless steel, non-ferromagnetic ferreous alloys, titanium and its alloys or molybdenum and its alloys.

The material which provides the surface of the backing member may comprise an oxide, nitride or other compound provided that the material can diffuse (with or without a chemical reaction) into the molten alloy to bond the alloy layer to the backing member. It is not clear whether the oxide, nitride or other compound reacts with metal of the alloy layer or whether its mere presence in the alloy is adequate to cause the alloy layer to bond to the backing member. Especially useful materials for providing the surface of the backing member are the oxides of metals which have tenacious oxide layers on their surfaces, for example titanium and aluminium. In the case of titanium, it may be that titanium dioxide diffuses from the surface of the backing member into the molten alloy where it is reduced to titanium metal.

The contact surface of the backing may be subjected to a mechanical roughening process such as shot blasting and/or to an oxidation process, preferably by treating it with air or an oxidising liquid such as sulphuric acid and/or by subjecting it to an anodising process. Oxidation has been found to be especially worthwhile if the surface comprises a tenacious oxide because (for reasons which are not understood) the oxidation process enhances the ability of the oxide to form zones.

If for some reason it is necessary to use a backing member formed of a material (for example a ceramic) which does not diffuse into the molten alloy, it is still possible to obtain a fusion bond between the backing member and the alloy layer by providing on the surface of the backing member a material which can both diffuse into the molten alloy and into the material forming the remainder of the backing member. For example, a silver/copper eutectic mixture containing minor additions of titanium provided on the surface of a ceramic backing member enables an alloy layer to be bonded thereto.

It can be useful to choose a backing member having a coefficient of expansion which is less than (preferably from 0.3 to 1.0 times) that of the solid alloy so that the unitary structure produced is bowed in such a way that the surface of the backing member facing the alloy layer is concave. This puts the surface of the alloy layer remote from the backing member into compression so minimising crack formation. To obtain a substantially flat structure, the backing member and the alloy must have similar coefficients of expansion. Preferably the coefficient of expansion should lie in the range $4\times10^{-6}$ to $10\times10^{-6}$/K.

It is preferred that the coefficient of thermal conductivity of the backing member should be greater than that of the solid alloy and most preferably it is from 5 to 400 W/mK.

According to a second aspect of this invention there is provided a unitary structure comprising a layer of transition metal alloy containing 15 to 35 at. % of rare earth metal wherein the transition metal consists of at least one member of the 4*b*, 5*b*, 6*b*, 7*b* and 8 Groups of the Periodic Table, the layer of transition metal alloy being bonded to a surface of a backing member.

Figure 2:
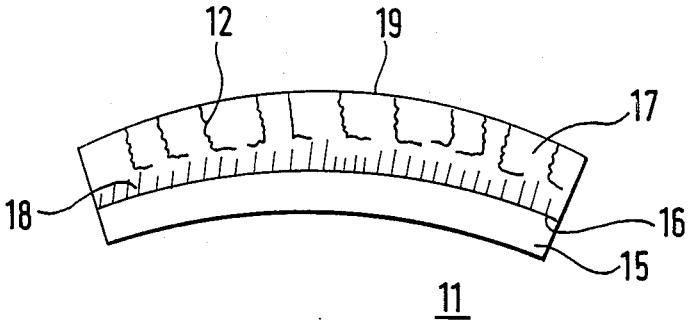
Figure 3:
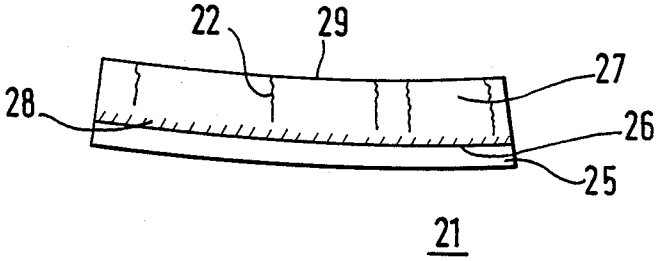

The invention is further illustrated, merely by way of example, with reference to the following drawings in which FIG. 1 shows in section a mould suitable for performing a process according to this invention;

FIG. 2 shows diagrammatically and in exaggerated elevation a unitary structure according to this invention comprising a copper backing member; and FIG. 3 shows diagrammatically and in exaggerated elevation a unitary structure according to this invention comprising a titanium backing member.

FIG. 1 shows a mould 1 composed of two mould halves 2 and 3. Mould half 2 contains a recess 4 in which a backing member 5 having a contact surface 6 is located. The mould halves 2 and 3 and the contact surface 6 define a space 7 between them.

In operation, molten alloy (not shown) is poured into the space 7 via an opening 8 and allowed to solidify in contact with the contact surface 6 of the backing member 5. The mould halves 2 and 3 are heated by means of electrical heating elements (not shown) in channels 9 which pass through each of the mould halves 2 and 3 and the temperature of the mould 1 is monitored by thermocouples (not shown) in channels 10 which also pass through each of the mould halves 2 and 3.

FIG. 2 shows a unitary structure 11 made by a process according to this invention with a copper backing member 15 with a contact surface 16 bonded to a layer of transition metal alloy 17 containing rare earth metal. Bonding is achieved by means of zones 18 (represented by shading lines) in which copper which has diffused from the contact surface 16 is mixed with the alloy of layer 17. A copper backing member has the advantages of having a high thermal conductivity and forming a good fusion bond to the alloy. But against these advantages must be set the disadvantage of the high coefficient of expansion of copper which causes the unitary structure 11 to bow in the unpreferred way, that is to say with the contact surface 16 convex to the alloy layer 17. This promotes the formation of cracks 12 which nevertheless terminate in the vicinity of the zones 18 and accordingly only extend part way across the alloy layer 17.

FIG. 3 shows an alternative unitary structure 21 made by a process according to this invention with a titanium backing member 25 with a contact surface 26 bonded to a layer of transition metal alloy 27 containing rare earth metal. Bonding is achieved by means of zones 28 (represented by shading lines) in which titanium moieties which have diffused from the contact surface 26 are mixed with the alloy of layer 27. The unitary structure 21 is slightly bowed such that the contact surface 26 is concave to the alloy layer 27 thereby putting surface 29 of the alloy layer 27 in compression and minimising the formation of cracks 22. Such cracks 22 as are formed terminate in the vicinity of the zones 28.

The invention is also illustrated by the following Examples.

EXAMPLE 1

A unitary structure composed of a layer of a transition metal alloy containing rare earth metal bonded to a copper backing member as shown in FIG. 2 was made using a mould as shown in FIG. 1. The copper backing member was 50 mm square and 3 mm thick and the alloy layer bonded to the backing member was 6 mm thick. The thermal conductivity of copper is 400 W/mK.

To make the structure, the mould halves were first heated to about 650° C. and molten alloy consisting of 68 at. % iron, 10 at. % cobalt and 22 at. % gadolinium at a temperature of 1400° C. was poured into the mould so as to contact a surface of the copper backing member. The alloy was then cooled at rate of about 5° C./min whereupon it solidified and bonded to the copper backing member. It was found that copper had diffused to a distance of 3 mm into the alloy layer so producing a zone of copper mixed with the alloy. The structure obtained was unitary and any cracks it contained did not penetrate all the way across the alloy layer.

EXAMPLE 2

The procedure of Example 1 was repeated except that a titanium backing member was used and the temperature of the molten alloy was 1450° C. on pouring into the mould. The surface of the titanium backing member had been oxidised by immersion in an anodising bath composed of 20% sulphuric acid operated using a potential difference of 18V at 20° C. for approximately 15 minutes. The thermal conductivity of titanium is 21.9 W/mK.

The solidified alloy bonded well to the titanium backing member and produced a concave bowed unitary structure as shown in FIG. 3.

EXAMPLE 3

The procedure of Example 2 was repeated using a similar mould and conditions. The backing member was formed of titanium with the normal tenacious titanium oxide layer present. The solidified alloy bonded well to the titanium backing member and produced a concave bowed unitary structure as shown in FIG. 3.

We claim:

1. A unitary structure (21) comprising a layer (27) of a transition metal alloy containing 15 to 35 atomic % of rare earth metal wherein the transition metal consists of at least one member of the 4*b*, 5*b*, 6*b*, 7*b* and 8 Groups of the Periodic Table, the layer (27) of transition metal alloy being bonded to a surface (26) of a backing member (25) through at least one zone (28) comprising said alloy mixed with material of the said surface (26).

2. A unitary structure (21) according to claim 1 wherein any cracks (12) or (22) in the alloy layer (27) extend part way and/or diagonally across the alloy layer (27).

3. A unitary structure (21) according to claim 1 wherein the backing member (25) has a coefficient of expansion less than that of the alloy layer.

4. A unitary structure (21) according to claim 1 wherein the backing member (25) has a coefficient of expansion in the range $4\times10^{-6}$ to $10\times10^{-6}$/K.

5. A unitary structure (21) according to claim 1 wherein the backing member (25) comprises titanium and the said surface (26) is provided by an oxide of titanium.

6. A unitary structure (21) according to claim 1, wherein the rare earth metal is selected from the group consisting of terbium, gadolinium and dysprosium.

7. A unitary structure (21) according to claim 1, wherein the backing member (25) is a ceramic material having a surface layer which bonds said alloy to the backing member by diffusion into said alloy and said backing member.

8. A unitary structure (21) according to claim 1, being a sputter target.

* * * * *